US007297674B2

(12) United States Patent
Hines

(10) Patent No.: US 7,297,674 B2
(45) Date of Patent: Nov. 20, 2007

(54) GEL LAUNDRY DETERGENT COMPOSITION

(75) Inventor: John David Hines, Bebington (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 398 days.

(21) Appl. No.: 10/941,670

(22) Filed: Sep. 15, 2004

(65) Prior Publication Data

US 2005/0059568 A1 Mar. 17, 2005

(30) Foreign Application Priority Data

Sep. 16, 2003 (EP) ..... 03255759

(51) Int. Cl.

| | |
|---|---|
| ***C11D 1/02*** | (2006.01) |
| ***C11D 1/66*** | (2006.01) |
| ***C11D 3/20*** | (2006.01) |
| ***C11D 9/26*** | (2006.01) |
| ***C11D 17/00*** | (2006.01) |

(52) U.S. Cl. ..... 510/483; 510/276; 510/336; 510/342; 510/351; 510/353; 510/356; 510/403; 510/437; 510/475

(58) Field of Classification Search ..... 510/276, 510/336, 342, 351, 353, 356, 403, 437, 475, 510/483

See application file for complete search history.

(56) References Cited

U.S. PATENT DOCUMENTS

| | | | | |
|---|---|---|---|---|
| 5,538,662 | A * | 7/1996 | Klier et al. | 510/284 |
| 5,820,695 | A | 10/1998 | Lance-Gomez et al. | 134/42 |
| 6,362,156 | B1 | 3/2002 | Hsu et al. | 510/418 |
| 6,794,347 | B2 | 9/2004 | Hsu et al. | |
| 6,794,348 | B2 | 9/2004 | Hsu et al. | |
| 6,815,409 | B2 | 11/2004 | Hsu et al. | |
| 6,849,587 | B2 | 2/2005 | Hsu et al. | |
| 7,018,970 | B2 | 3/2006 | Hsu et al. | |

FOREIGN PATENT DOCUMENTS

| | | |
|---|---|---|
| EP | 724 011 | 7/1996 |
| WO | 94/28108 | 12/1994 |
| WO | 99/06519 | 2/1999 |
| WO | 99/27065 | 6/1999 |

OTHER PUBLICATIONS

European Search Report EP 03 25 5759.

* cited by examiner

*Primary Examiner*—Brian Mruk
(74) *Attorney, Agent, or Firm*—Rimma Mitelman

(57) ABSTRACT

The present invention provides a shear thinning, transparent gel laundry detergent composition, comprising a surfactant system containing surfactant material selected from an anionic surfactant, a nonionic surfactant or a mixture thereof, and from 0.1 to 10% by weight of a clarity improving agent being a glycol dialkyl ether selected from a mono-or polyethylene glycol dialkyl ether having the formula $$(C_pH_{2p+1})O—(CH_2CH_2O)_n—(C_qH_{2q+1}), \quad (I)$$

a mono- or polypropylene glycol dialkyl ether having the formula $$(C_pH_{2p+1})O—(CH_2CH\ (CH_3)O)_n—(C_qH_{2q+1}), \quad (II)$$

and mixtures thereof, wherein p and q independently are integers in the range of from 1 to 5, and n is an integer in the range of from 1 to 50, preferably 1 to 10. It has been found that this gel laundry composition is highly transparent, such that particles can be suspended therein for improving visual appearance.

15 Claims, No Drawings

GEL LAUNDRY DETERGENT COMPOSITION

FIELD OF THE INVENTION

The present invention relates to stable gel laundry detergent compositions. In particular, the invention relates to stable, transparent, shear thinning, heavy-duty, lamellar-phase gel laundry detergent compositions, comprising anionic and nonionic surfactant material, and preferably a gelling agent.

BACKGROUND OF THE INVENTION

For a variety of reasons, it is often greatly desirable to suspend particles in liquid detergent compositions. For example, because there are certain components (e.g. bleaches, enzymes, perfumes) which readily degrade in the hostile environment of surfactant-containing detergent liquids, these components are often protected in capsule-type particles (see, for example, U.S. Pat. No. 5,281,355) and these capsule-type particles may be suspended in liquid detergent compositions. Other components that may be protected and suspended in this way are, for instance, polyvinylpyrrolidone, aminosilicones, soil release agents and antiredeposition agents. Such particles may vary significantly in size but, usually, their size is in the range of from 300 to 5000 micrometers.

Furthermore, when the liquid detergent composition is translucent or transparent, it may be desirable to suspend coloured particles or capsules of similar size in said liquid composition so as to improve the visual appearance thereof.

Shear thinning gel-type detergent compositions are generally suitable for stably suspending particles therein, since they usually have adequate viscosity when in rest or under very low shear. On the other hand, owing to their shear thinning properties, such gel-type compositions have much lower viscosity when under pouring shear.

One way of formulating such gel-type detergents is by changing a non-gelled formulation so as to form an internal lamellar-phase structure therein which structure gives the desired properties to the thus-formed gel-type detergent.

WO-A-99/27065, WO-A-99/06519 and U.S. Pat. No. 5,820,695 disclose gel-type laundry detergent compositions having an internal structure. These documents teach systems wherein soap or fatty acid in combination with sodium sulphate and a rather specific surfactant system are used to form a gelled structure by the formation of lamellar phases.

Alternatively, shear thinning gel-type detergent compositions may be formulated by adding specific ingredients to a non-gelled detergent formulation, typically at low dosage, so as to induce gellation.

Examples of this route for preparing gelled detergents are disclosed in U.S. Pat. No. 6,362,156. More specifically, this document discloses shear thinning, transparent gel-type laundry compositions comprising a polymer gum, such as Xanthan gum, which gum is capable of forming stable continuous gum networks which can suspend particles.

However, when using a polymer additive such as the polymer gum disclosed in U.S. Pat. No. 6,362,156, so as to form the gelling structure, it is generally required to carry out several specific steps in the manufacturing process in order that the gel structure is properly formed. These steps are relatively costly and make the manufacturing process rather time-consuming.

In addition, the 'structure' of the gel-type detergent composition disclosed by U.S. Pat. No. 6,362,156 resides in the dispersed polymeric network and not in the continuous bulk phase, which remains essentially isotropic in nature. For that reason, particles suspended in this system tend—over time—to migrate through the network leading to asymmetrical dispersions which is clearly not desirable for a gel-type detergent product.

Alternatively, U.S. Pat. No. 5,952,286 discloses skin cleansing compositions comprising lamellar phase dispersions from rad micellar surfactant systems, and additionally a structurant for establishing the lamellar phase, whereby said structurant may be a fatty alcohol. These compositions are structured as lamellar vesicles, and are opaque, and therefore unsuitable for the visual display of suspended particles or capsules.

Furthermore, copending U.S. patent application Ser. No. 10/251,738 and European patent application 02257682.1 disclose stable shear-thinning tranlucent gel laundry detergent formulations comprising a fatty acid respectively a fatty alcohol as gelling agent. Without wishing to be bound by theory, it is believed that these types of gelling agent interact with aggregates present in the respective detergent formulations so as to promote the formation of planar lamellar structures similar to those found in internally structured detergent gels, such as e.g. disclosed by WO-A-99/27065.

However, a major disadvantage of this technology relating to shear-thinning, stable, structured detergent gels is that such products structured by lamellar phases are often rather turbid in appearance. As a consequence, their transparency often leaves to be desired.

In view of this, it is an object of the present invention to find a stable shear-thinning lamellar-phase gel laundry detergent formulation which is highly transparent or translucent and provides favourable visual appearance so as to clearly demonstrate the presence of any particles, beads or capsules suspended therein. It is another object of the invention to provide a shear thinning lamellar-phase gel laundry detergent formulation that has both favourable transparency and cleaning performance.

It has been surprisingly found that these objects could be achieved by applying the shear thinning transparent gel laundry detergent composition of the present invention, containing a clarity-improving agent, as specified in claim 1.

DEFINITION OF THE INVENTION

Accordingly, the present invention provides a shear thinning, transparent lamellar-phase gel laundry detergent composition, comprising a surfactant system containing surfactant material selected from an anionic surfactant, a nonionic surfactant or a mixture thereof, and from 0.1 to 10% by weight of a clarity improving agent being a glycol dialkyl ether selected from a mono- or polyethylene glycol dialkyl ether having the formula $$(C_pH_{2p+1})O—(CH_2CH_2O)_n—(C_qH_{2q+1}) \quad (I),$$

a mono- or polypropylene glycol dialkyl ether having the formula $$(C_pH_{2p+1})O—(CH_2CH(CH_3)O)_n—(C_qH_{2q+1}) \quad (II),$$

and mixtures thereof, wherein p and q independently are integers in the range of from 1 to 5, and n is an integer in the range of from 1 to 50, preferably 1 to 10, more preferably 1 to 5.

The present invention is also concerned with the use of a glycol dialkyl ether as a clarity improving agent in a shear thinning, transparent, lamellar-phase gel laundry detergent composition of the invention.

The present invention further provides a method of improving the clarity and transparency of a shear thinning, transparent, lamellar-phase gel laundry detergent composition, said method comprising the steps of (a) preparing said composition by mixing the ingredients thereof, said composition comprising a surfactant system containing surfactant material selected from an anionic surfactant, a nonionic surfactant or a mixture thereof, and (b) adding from 0.1 to 10% by weight of a glycol dialkyl ether according to the invention, to said composition.

DETAILED DESCRIPTION OF THE INVENTION

In general, the gel laundry detergent composition of the invention is structured internally by a lamellar phase such that the phase volume of material present within the lamellar structure is at least 0.75 and preferably greater than 0.9. In other words, the neat liquid crystal lamellar phase occupies at least 75%, preferably at least 90% of the volume occupied by the detergent composition of the invention. Most preferably, the detergent composition of the invention is characterised by the substantial absence of any other phases. As a practical test for determining this property of a composition of the invention, this composition is centrifuged at 25° C. and at 2000×g (where $g=9.81\ ms^{-2}$) for 6 hours; after this treatment said composition does not yield any separate layer of more than 25 of the total height of the centrifuged composition when held in a cylindrical container of uniform thickness.

The lamellar phase composition of the invention is characterised by a neat liquid crystal lamellar phase, comprising the surfactants and, optionally, the gelling agents present in the composition, and arranged at the molecular level in planar lamellar bi-layers with the other ingredients of the composition dispersed in the spaces between the hydrophilic faces of the lamellar sheets. Such a lamellar phase is conventionally referred to in several ways: as "neat phase", Lam phase (Laughlin), L phase (Luzatti), G phase (Winsor) or D phase (Ekwall) (see R G Laughlin, "The Aqueous Phase Behaviour of Surfactants", for example). The presence of the lamellar phase can be observed optically using birefringence.

The microstructure of such a lamellar phase system at the mesoscopic (as opposed to molecular) level may be vescicular or continuous planar or a combination thereof including any other combinations of variable curvatures. Such a lamellar phase gel laundry detergent composition is desirably highly transparent, such that particles (if present) can be suspended therein and can easily be seen, for improving visual appearance.

By "transparent", it is meant that light is easily transmitted through the composition of the invention and that objects on one side of the gel composition are at least partially visible from the other side of the composition. Alternatively, the transparency of the gel detergent composition is defined in that said composition has suitably at least 50%, preferably at least 70% transmittance of light using a 1 centimeter cuvette at a wavelength of 410-800 nm, preferably 570-690 nm, whereby the composition is measured in the absence of dyes.

The lamellar-phase gel composition of the invention is also preferably an aqueous composition having a free water concentration of more than 25%, more preferably more than 50% by weight.

Furthermore, the lamellar-phase gel laundry detergent composition of the invention is generally relatively viscous, and has preferably a viscosity of at least 100 Pa·s, more preferably at least 500 Pa·s, when in rest or up to a shear stress of 10 Pa.

As a consequence, the composition of the invention is very suitable for stably suspending relatively large particles, such as those having a size of from 300 to 5000 microns. Furthermore, syneresis leading to a net migration of suspended matter has never been observed in the gel composition of the invention. Preferably, the composition of the invention contains 0.1 to 10% by weight of suspended particles having a size within the range mentioned above.

On the other hand, the shear thinning properties of the gel laundry detergent composition of the invention are such that its viscosity under a shear stress of 100 Pa or greater is at most 5 Pa·s, preferably at most 1 Pa·s, more preferably at most 0.5 Pa·s. The shear thinning behaviour of the gel composition of the invention ensures that it can be easily poured. Furthermore, a micro-emulsion is desirably not present in said gel composition.

The lamellar-phase gel detergent composition of the invention is also stable, which means that it does not phase separate when stored for at least 2 weeks at room temperature. Furthermore, the surfactant system contained in the gel laundry composition of the present invention is preferably substantially free of any amphoteric or zwitterionic surfactant.

The Clarity Improving Agent

The shear thinning, transparent lamellar-phase gel laundry detergent composition of the present invention contains from 0.1 to 10%, preferably from 0.5 to 5%, more preferably from 1 to 4%, by weight, of a clarity improving agent being a glycol dialkyl ether as specified in claim 1. Such relatively low amounts were observed to be quite sufficient for obtaining a highly transparent gel laundry composition showing favourable cleaning performance.

Preferably, the clarity improving agent is a glycol dialkyl ether according to formula (I) or (II), wherein p and q are integers having equal values. More preferably, the clarity improving agent of the invention is a glycol dialkyl ether according to formula (I) or (II) wherein said ether has straight chain alkyl groups.

The clarity improving agent is most preferably selected from the group consisting of polyethylene glycol dibutyl ether and polypropylene glycol dibutyl ether.

Without wishing to be bound by theory, it is believed that in the present case the amphiphilic nature of the glycol dialkyl ethers of the present invention causes them to partition preferentially into the lamellar structures, thus enhancing the liquid-like nature and flexibility thereof. This in turn leads to a decrease in fracturing of the lamellar phase and, consequently, the clarity of the composition is increased.

Gelling Agent

Preferably, the lamellar-phase gel laundry composition of the invention comprises from 1 to 8%, more preferably from 3 to 6%, by weight of a gelling agent.

Such a gelling agent may suitably be a fatty alcohol having the formula $R_1$—(CHOH)—$R_2$, wherein $R_1$, $R_2$ are independently selected from hydrogen and saturated or unsaturated, linear or branched, $C_1$-$C_{16}$ alkyl groups, whereby the total number of carbon atoms in the fatty alcohol is between 8 and 17.

Preferably a fatty alcohol gelling agent is used that has the above formula, wherein $R_1$ is hydrogen and $R_2$ is selected from saturated or unsaturated, linear or branched $C_9$-$C_{13}$ alkyl groups. Favourable results could generally be obtained when applying as gelling agent a fatty alcohol in which the total chain length is similar to the average chain length of the surfactants present in the formulation. Such a gelling agent is preferably selected from the group consisting of 1-decanol, 1-dodecanol, 2-decanol, 2-dodecanol, 2-methyl-1-decanol, 2-methyl-1-dodecanol, 2-ethyl-1-decanol, and mixtures thereof. Commercially available materials that are particularly suitable for use as gelling agent include Neodol 23 or Neodol 25 produced by Shell Chemical Co., Exxal 12 or Exxal 13 produced by Exxonmobil Chemical Co. and Isalchem 123 or Lialchem 123 produced by Sasol Chemical Co.

The gelling agent may also suitably be a non-neutralised fatty acid having the formula $R_3$—(COOH)—$R_4$, wherein $R_3$ and $R_4$ are independently selected from hydrogen and saturated or unsaturated, linear or branched $C_1$-$C_{22}$ alkyl groups, whereby the total number of carbon atoms in the fatty acid is between 10 and 23. Such a fatty acid gelling agent is preferably selected from oleic acid, lauric acid, myristic acid, palmitic acid, stearic acid, linoleic acid, linolenic acid and mixtures thereof.

Furthermore, the gelling agent may suitably be a naturally obtainable fatty acid selected from tallow, coconut, and pal kernel fatty acids.

Anionic Surfactant

The anionic surfactant that may be present in the gel composition of the invention is preferably selected from the group consisting of linear alkyl benzene sulphonates, alkyl sulphonates, alkylpolyether sulphates, alkyl sulphates and mixtures thereof.

The linear alkyl benzene sulphonate (LAS) materials and their preparation are described for example in U.S. Pat. Nos. 2,220,099 and 2,477,383, incorporated herein by reference.

Particularly preferred are the sodium, potassium and mono-, di-, or tri-ethanolamminium linear straight chain alkylbenzene sulphonates in which the average number of carbon atoms in the alkyl group is from 11 to 14. Sodium salt of C11-C14, e.g. C12, LAS is especially preferred.

Preferred anionic surfactants also include the alkyl sulphate surfactants being water soluble salts or acids of the formula ROSO3M, wherein R preferably is a C10-C24 hydrocarbyl, preferably an alkyl or hydroxyalkyl having a C10-C18 alkyl group, more preferably a C12-C15 alkyl or hydroxyalkyl, and wherein M is H or a cation, e.g. an alkali metal cation (e.g. sodium, potassium, lithium), or ammonium or substituted ammonium, especially mono-, di-, or tri-ethanolammonium. Most preferably, M is sodium.

Further preferred anionic surfactants are alkyl sulphonates, and desirably those in which the alkyl groups contain 8 to 26 carbon atoms, preferably 12 to 22 carbon atoms, and more preferably 14 to 18 carbon atoms.

The alkyl substituent is preferably linear, i.e. normal alkyl, however, branched chain alkyl sulphonates can be employed, although they are not as good with respect to biodegradability. The alkyl substituent may also be terminally sulphonated or may be joined to any carbon atom on the alkyl chain, i.e. may be a secondary sulphonate. The alkyl sulphonates can be used as the alkali metal salts, such as sodium and potassium. The preferred salts are the sodium salts. The preferred alkyl sulphonates are the C10 to C18 primary normal alkyl sodium sulphonates.

Also, alkyl polyether sulphates are preferred anionic surfactants for use in the composition of the invention. These polyether sulphates may be normal or branched chain alkyl and contain lower alkoxy groups which can contain two or three carbon atoms. The normal alkyl polyether sulphates are preferred in that they have a higher degree of biodegradability than the branched chain alkyl, and the alkoxy groups are preferably alkoxy groups.

The preferred alkyl polyethoxy sulphates used in accordance with the present invention are represented by the formula:

$$R_1—O(CH_2CH_2O)_p—SO_3M,$$

wherein:

R1 is $C_8$ to $C_{20}$ alkyl, preferably $C_{12}$ to $C_{15}$ alkyl;

p is 2 to 8, preferably 2 to 6, and more preferably 2 to 4; and

M is an alkali metal, such as sodium and potassium, or an ammonium cation. The sodium salt is preferred.

The surfactant system of the invention may additionally contain fatty acid soaps. These can be derived from saturated and non-saturated fatty acids obtained from natural sources and synthetically prepared. Examples of such fatty acids include capric, lauric, myristic, palmitic, stearic, oleic, linoleic and linolenic acid. The non-neutralised fatty acids may also suitably function as gelling agent, as above described.

The concentration of the anionic surfactant in the gel composition of the invention is preferably in the range of from 5 to 50%, more preferably from 5 to 25% by weight. The anionic surfactant material may be incorporated in free and/or neutralised form.

Nonionic Surfactant

The surfactant system in the gel composition of the invention may also contain a nonionic surfactant.

Nonionic detergent surfactants are well-known in the art. They normally consist of a water-solubilizing polyalkoxylene or a mono- or d-alkanolamide group in chemical combination with an organic hydrophobic group derived, for example, from alkylphenols in which the alkyl group contains from about 6 to about 12 carbon atoms, dialkylphenols in which primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylene. Also common are fatty acid mono- and dialkanolamides in which the alkyl group of the fatty acidradical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule.

In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in European specification EP-A-225, 654. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide.

The nonionic surfactant is preferably present in the gel composition of the invention at a concentration of from 5 to 50% by weight, more preferably from 5 to 30% by weight.

Builders

Builders that may be used according to the present invention include conventional alkaline detergent builders, inorganic or organic, which can be used at levels of from 0% to 50% by weight of the gel composition, preferably from 1% to 35% by weight.

Examples of suitable inorganic detergency builders that may be used are water soluble alkali metal phosphates, polyphosphates, borates, silicates, and also carbonates and bicarbonates. Specific examples of such builders are sodium and potassium triphosphates, pyrophosphates, orthophosphates, hexametaphosphates, tetraborates, silicates, and carbonates.

Examples of suitable organic detergency builders are: (1) water-soluble amino polycarboxylates, e.g. sodium and potassium ethylenediaminetetraacetates, nitrilotriacetates and N-(2 hydroxyethyl)-nitrilodiacetates; (2) water-soluble salts of phytic acid, e.g. sodium and potassium phytates; (3) water-soluble polyphosphonates, including specifically sodium and potassium salts of ethane-1-hydroxy-1,1-diphosphonic acid; sodium and potassium salts of methylene diphosphonic acid; sodium and potassium salts of ethylene diphosphonic acid; and sodium and potassium salts of ethane-1,1,2-triphosphonic acid.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, and tartrate disuccinate.

Desirably, the detergency builder is selected from the group consisting of carboxylates, polycarboxylates, aminocarboxylates, carbonates, bicarbonates, phosphates, phosphonates, silicates, borates and mixtures thereof.

Alkalimetal (i.e. sodium or potassium) citrate is most preferred builder material for use in the invention.

Amorphous and crystalline zeolites or aluminosilicates can also be suitably used as detergency builder in the gel composition of the invention.

Enzymes

Suitable enzymes for use in the present invention include proteases, amylases, lipases, cellulases, peroxidases, and mixtures thereof, of any suitable origin, such as vegetable, animal bacterial, fungal and yeast origin. Preferred selections are influenced by factors such as pH-activity, thermostability, and stability to active bleach detergents, builders and the like. In this respect bacterial and fungal enzymes are preferred such as bacterial proteases and fungal cellulases.

Enzymes are normally incorporated into detergent composition at levels sufficient to provide a "cleaning-effective amount". The term "cleaning effective amount" refers to any amount capable of producing a cleaning, stain removal, soil removal, whitening, or freshness improving effect on the treated substrate. In practical terms for normal commercial operations, typical amounts are up to about 5 mg by weight, more typically 0.01 mg to 3 mg, of active enzyme per gram of detergent composition. Stated otherwise, the composition of the invention may typically comprise from 0.001 to 5%, preferably from 0.01 to 1% by weight of a commercial enzyme preparation.

Protease enzymes are usually present in such commercial preparations at levels sufficient to provide from 0.005 to 0.1 Anson units (AU) of activity per gram of composition. Higher active levels may be desirable in highly concentrated detergent formulations.

Suitable examples of proteases are the subtilisins that are obtained from particular strains of *B. subtilis* and *B. licheniformis*. One suitable protease is obtained from a strain of *Bacillis*, having maximum activity throughout the pH-range of 8-12, developed and sold as ESPERASE® by Novo Industries A/S of Denmark.

Other suitable proteases include ALCALASE® and SAVINASE® from Novo and MAXATASE® from International Bio-Synthetics, Inc., The Netherlands.

Suitable lipase enzymes for use in the composition of the invention include those produced by microorganisms of the *Pseudomonas* group, such as *Pseudomonas stutzeri* ATCC 19.154, as disclosed in GB-1,372,034. A very suitable lipase enzyme is the lipase derived from *humicola lanuginosa* and available from Novo Nordisk under the tradename LIPOLASE™.

Other Optional Components

In addition to the anionic and nonionic surfactants described above, the surfactant system of the invention may optionally contain a cationic surfactant.

Furthermore, alkaline buffers may be added to the compositions of the invention, including monethanolamine, triethanolamine, borax, and the like.

As another optional ingredient, an organic solvent may suitably be present in the gel composition of the invention, preferably at a concentration of up to 10% by weight.

There may also be included in the formulation, minor amounts of soil suspending or anti-redeposition agents, e.g. polyvinyl alcohol, fatty amides, sodium carboxymethyl cellulose or hydroxy-propyl methyl cellulose.

Optical brighteners for cotton, polyamide and polyester fabrics, and anti-foam agents such as silicone oils and silicone oil emulsions may also be used.

Other optional ingredients which may be added in minor amounts, are soil release polymers, dye transfer inhibitors, polymeric dispersing agents, suds suppressors, dyes, perfumes, colourants, filler salts, antifading agents and mixtures thereof.

The invention will now be illustrated with reference to the following examples, in which parts and percentages are by weight.

EXAMPLES A1-A7, B1-B7

The following basic gel laundry detergent compositions were prepared:

| | Wt % | |
|---|---|---|
| Component: | A | B |
| Propylene glycol | 4.75 | 4.75 |
| Borax | 2.3 | 0.0 |
| Sodium Silicate | 0.0 | 2.0 |
| NaOH (50%) | 0.5 | 0.5 |
| LAS-acid | 8.5 | 8.5 |
| Nonionic surfactant | 6.5 | 6.5 |
| C12-14 alcohol | 4.0 | 4.0 |
| Protease enzyme | 0.45 | 0.0 |
| Perfume | 0.2 | 0.2 |
| Water | balance to 100 | balance to 100 |

To these basic formulations A and B were added varying amounts of the clarity improving agent diethylene glycol dibutyl ether, such that the following sets of final formulations were obtained:

| | Wt % clarity improving agent |
|---|---|
| Formulations A1 and B1 | 0.0 |
| Formulations A2 and B2 | 0.3 |
| Formulations A3 and B3 | 0.5 |
| Formulations A4 and B4 | 1.0 |
| Formulations A5 and B5 | 2.0 |
| Formulations A6 and B6 | 3.0 |
| Formulations A7 and B7 | 5.0 |

In other words, formulations A1-A7 respectively B1-B7 have been derived from the basic formulations A and B, by adding to these basic formulations varying amounts of the clarity improving agent diethylene glycol dibutyl ether, such that for each final formulation the indicated concentration of said clarity improving agent is obtained.

The thus-obtained final formulations were all detergent gels. The clarity of the obtained formulations was measured using the following procedure:

The formulation to be measured is poured slowly into a suitable flat bottomed, transparent vessel, such as a cylindrical vial. This vessel containing the formulation is then placed over a black cross, printed in black ink using standard 3.0 point lines on white paper. A visual assessment is made of the visibility of the cross when viewed through the formulation and more of said formulation is added to the container until the cross can only just be visualised through the gel. At this point, a measurement is taken of the height of the formulation in the container; in other words, the path length through which the cross is only just seen. This measurement is taken in a well-lit room and by a consistent operator. Alternatively, a light box may be placed under the paper on which the cross is printed to provide consistent illumination from below. This latter adjustment may modify the scale of the result, but in our experience does not change the relative results obtained when all measurements are carried out consistently.

The results of these clarity measurements carried out using the method described above are given for the formulations listed in the tables below. For formulations having higher clarity, greater heights or visual path lengths were observed:

| Formulation | A1 | A2 | A3 | A4 | A5 | A6 | A7 |
|---|---|---|---|---|---|---|---|
| Height/mm | 27 | 32 | 35 | 37 | 46 | 52 | 58 |
| Formulation | B1 | B2 | B3 | B4 | B5 | B6 | B7 |
| Height/mm | 6 | 6 | 6 | 7 | 35 | 50 | 57 |

In the first case of basic formulation A and derivative final formulations A1-A7, the starting formulation A is a reasonably clear gel of good transmittance which is improved significantly by addition of the clarity improving agent. In the second case of starting formulation B and derivative final formulations B1-B7, the starting formulation B is a rather opaque gel of which the transmittance is improved dramatically by addition of the claimed clarity improving agent.

The invention claimed is:

1. A shear thinning, transparent lamellar-phase gel laundry detergent composition, comprising a surfactant system containing surfactant material selected from an anionic surfactant, a nonionic surfactant or a mixture thereof, and from 0.5 to 5% by weight of a clarity improving agent being a glycol dialkyl ether selected from a mono- or polyethylene glycol dialkyl ether having the formula $$(C_pH_{2p+1})O—(CH_2CH_2O)_n—(C_qH_{2q+1}) \quad (I)$$

a mono- or polypropylene glycol dialkyl ether having the formula $$(C_pH_{2p+1})O—(CH_2CH(CH_3)O)_n—(C_qH_{2q+1}) \quad (II),$$

and mixtures thereof, wherein p and q independently are integers in the range of from 1 to 5, and n is an integer in the range of from 1 to 50, preferably 1 to 10.

2. A composition according to claim 1, wherein the clarity improving agent is selected from the group consisting of polyethylene glycol dibutyl ether and polypropylene glycol dibutyl ether.

3. A composition according to claim 1, wherein the composition further comprises from 1 to 8% by weight of a gelling agent.

4. A composition according to claim 3, wherein the gelling agent is a fatty alcohol having the formula $$R_1—(CHOH)—_2 \quad (III),$$

wherein:

$R_1$, $R_2$ are independently selected from hydrogen and saturated or unsaturated, linear or branched, $C_1$—$C_{16}$ alkyl groups, wherey the total number of carbon atoms in the fatty alcohol is between 8 and 17.

5. A composition according to claim 4, wherein the fatty alcohol gelling agent is selected from 1-decanol, 1-dodecanol, 2-decanol, 2-dodecanol, 2-methyl-1-decanol, 2-methyl-1-dodecanol, 2-ethyl-1-decanol, and mixtures thereof.

6. A composition according to claim 3, wherein the gelling agent is a non-neutralised fatty acid having the formula $$R_3—(COOH)—R_4 \quad (IV),$$

wherein:

R3 and R4 are independently selected from hydrogen and saturated or unsaturated, linear or branched $C_1$-$C_{22}$ alkyl groups, whereby the total number of carbon atoms in the fatty acid is between 10 and 23.

7. A composition according to claim 6, wherein the fatty acid gelling agent is selected from oleic acid, lauric acid, myristic acid, palmitic acid, stearic acid, linoleic acid, linolenic acid and mixtures thereof.

8. A composition according to claim 3, wherein the gelling agent is a naturally obtainable fatty acid selected from tallow, coconut, and palm kernel fatty acids.

9. A composition according to claim 1, wherein the surfactant system contains an anionic surfactant selected from the group consisting of linear alkyl benzene sulphonate, alkyl polyether sulphate, alkyl sulphate, alkyl sulphonate and mixtures thereof.

10. A composition according to claim 1, wherein the anionic surfactant is present at a concentration of from 5 to 50% by weight, preferably from 5 to 25% by weight.

11. A composition according to claim 1, wherein the nonionic surfactant is an ethoxylated alcohol having 3 to 11 ethylene oxide groups.

12. A composition according to claim 1, wherein the nonionic surfactant is present at a concentration of from 5 to 50% by weight, preferably from 5 to 30% by weight.

13. A composition according to claim 1, wherein the composition additionally comprises a detergency builder selected from the group consisting of carboxylates, polycarboxylates, aminocarboxylates, carbonates, bicarbonates, phosphates, phosphonates, silicates, borates, and mixtures thereof.

14. A composition according to claim 1, wherein the composition has at least 50%, preferably at least 70%, transmittance of light using a 1 centimeter cuvette at a wavelength of 410-800 nm, preferably 570-690 nm, whereby the composition is measured in the absence of dyes.

15. Method of improving the clarity and transparency of a shear thinning, transparent, lamellar-phase gel laundry detergent composition, said method comprising the steps of (a) preparing said composition by mixing the ingredients thereof, said composition comprising a surfactant system containing surfactant material selected from an anionic surfactant, a nonionic surfactant or a mixture thereof, and (b) adding from 0.5-5 by weight of a glycol dialkyl ether, as specified in claim 1, to said composition.

* * * * *